US009570066B2

(12) United States Patent
Talwar et al.

(10) Patent No.: US 9,570,066 B2
(45) Date of Patent: Feb. 14, 2017

(54) SENDER-RESPONSIVE TEXT-TO-SPEECH PROCESSING

(75) Inventors: Gaurav Talwar, Farmington Hills, MI (US); Xufang Zhao, Windsor (CA); Ron M. Hecht, Raanana (IL)

(73) Assignee: General Motors LLC, Detroit, MI (US)

( * ) Notice: Subject to any disclaimer, the term of this patent is extended or adjusted under 35 U.S.C. 154(b) by 575 days.

(21) Appl. No.: 13/550,009

(22) Filed: Jul. 16, 2012

(65) Prior Publication Data

US 2014/0019135 A1 Jan. 16, 2014

(51) Int. Cl.
*G10L 13/08* (2013.01)
*G10L 13/033* (2013.01)

(52) U.S. Cl.
CPC ..... *G10L 13/08* (2013.01); *G10L 13/033* (2013.01)

(58) Field of Classification Search
CPC ..... G10L 13/00; G10L 2013/00
USPC ..... 704/258
See application file for complete search history.

(56) References Cited

U.S. PATENT DOCUMENTS 5,758,320 A * 5/1998 Asano ..... 704/258
6,289,085 B1 * 9/2001 Miyashita et al. ..... 379/88.02
6,408,273 B1 * 6/2002 Quagliaro et al. ..... 704/271
6,778,962 B1 * 8/2004 Kasai et al. ..... 704/266
6,810,378 B2 * 10/2004 Kochanski et al. ..... 704/258
7,263,489 B2 * 8/2007 Cohen ..... H04M 3/493 379/256
7,483,832 B2 * 1/2009 Tischer ..... 704/260
7,657,289 B1 * 2/2010 Levy et al. ..... 455/563
7,664,645 B2 * 2/2010 Hain ..... G06F 3/167 704/220
7,869,998 B1 * 1/2011 Di Fabbrizio et al. ..... 704/251
7,920,682 B2 * 4/2011 Byrne et al. ..... 379/88.18
8,024,193 B2 * 9/2011 Bellegarda ..... 704/269
8,077,836 B2 * 12/2011 Gilbert ..... 379/88.03
8,364,488 B2 * 1/2013 Kurzweil et al. ..... 704/260
8,370,151 B2 * 2/2013 Kurzweil ..... G10L 13/00 704/231
8,548,807 B2 * 10/2013 Ljolje et al. ..... 704/254
8,645,140 B2 * 2/2014 Lobzakov ..... 704/260
8,949,125 B1 * 2/2015 Chechik ..... G10L 13/02 701/409
2002/0072900 A1 * 6/2002 Keough et al. ..... 704/220
2003/0009338 A1 * 1/2003 Kochanski ..... G10L 13/10 704/260
2003/0028380 A1 * 2/2003 Freeland et al. ..... 704/260
2004/0111271 A1 * 6/2004 Tischer ..... 704/277
2004/0193421 A1 * 9/2004 Blass ..... G06F 17/278 704/258
2005/0096909 A1 * 5/2005 Bakis et al. ..... 704/260
2006/0271627 A1 * 11/2006 Szczepanek ..... 709/204
2007/0112570 A1 * 5/2007 Kaneyasu ..... G10L 13/06 704/260
2007/0174396 A1 * 7/2007 Kumar et al. ..... 709/206
2007/0203702 A1 * 8/2007 Hirose ..... G10L 13/06 704/256

(Continued)

*Primary Examiner* — Fariba Sirjani
(74) *Attorney, Agent, or Firm* — Christopher DeVries; Reising Ethington P.C.

(57) ABSTRACT

A method of speech synthesis including receiving a text input sent by a sender, processing the text input responsive to at least one distinguishing characteristic of the sender to produce synthesized speech that is representative of a voice of the sender, and communicating the synthesized speech to a recipient user of the system.

16 Claims, 5 Drawing Sheets

(56) References Cited

U.S. PATENT DOCUMENTS

| | | | | |
|---|---|---|---|---|
| 2007/0276666 | A1* | 11/2007 | Rosec | G10L 13/07 704/260 |
| 2008/0004880 | A1* | 1/2008 | Acero et al. | 704/270.1 |
| 2008/0034044 | A1* | 2/2008 | Bhakta et al. | 709/206 |
| 2008/0065378 | A1* | 3/2008 | Siminoff | 704/235 |
| 2008/0291325 | A1* | 11/2008 | Teegan et al. | 348/552 |
| 2009/0141875 | A1* | 6/2009 | Demmitt et al. | 379/88.14 |
| 2012/0239390 | A1* | 9/2012 | Fume et al. | 704/220 |

* cited by examiner

SENDER-RESPONSIVE TEXT-TO-SPEECH PROCESSING

TECHNICAL FIELD

The present invention relates generally to speech signal processing and, more particularly, to speech synthesis.

BACKGROUND

In general, speech signal processing involves processing electrical and/or electronic signals for recognition or synthesis of speech. Speech synthesis includes production of speech from text, and text-to-speech (TTS) systems provide an alternative to conventional computer-to-human visual output devices like computer monitors or displays. Conversely, speech recognition includes translation of speech into text, and automatic speech recognition (ASR) systems provide an alternative to conventional human-to-computer tactile input devices such as keyboards or keypads.

TTS and ASR technologies may be combined to provide a user with hands-free audible interaction with a system. For example, a telematics system in a vehicle may receive text messages, e-mails, tweets, or the like, use TTS technology to present them in audible form for a driver, receive a verbal response from the driver, and use ASR technology to convert the verbal response to machine readable form for carrying out vehicle control, or textual form for reply as a text message, e-mail, tweet, or the like.

But one problem encountered with TTS technology is that synthesized speech sounds undesirably artificial, and not like a natural human voice. For example, TTS-synthesized speech can have poor prosodic characteristics, such as intonation, pronunciation, stress, articulation rate, tone, and naturalness. Poor prosody can lead to confusion or disappointment of a TTS user and, thus, result in incomplete interaction with the user. To improve TTS quality, one solution includes collection and use of significantly more recorded voice data, and another solution includes development of more sophisticated TTS processing algorithms. But those solutions are time consuming and costly.

SUMMARY

According to one aspect of the invention, there is provided a method of speech synthesis, including the following steps:

(a) receiving, at a text-to-speech system, a text input sent by a sender;

(b) processing, via a processor of the system, the text input responsive to at least one distinguishing characteristic of the sender to produce synthesized speech that is representative of a voice of the sender; and (c) communicating the synthesized speech to a recipient user of the system.

According to another embodiment of the invention, there is provided a method of speech synthesis, including the following steps:

(a) obtaining at least one distinguishing characteristic of a sender during a communication session with the sender;

(b) storing the at least one distinguishing characteristic;

(c) receiving, at a text-to-speech (TTS) system, a text input sent by the sender in a subsequent communication session with the sender;

(d) processing, via a processor of the system, the text input responsive to the stored at least one distinguishing characteristic to produce synthesized speech that is representative of a voice of the sender of the text input; and (e) communicating the synthesized speech to a user of the system.

BRIEF DESCRIPTION OF THE DRAWINGS

One or more preferred illustrative embodiments of the invention will hereinafter be described in conjunction with the appended drawings, wherein like designations denote like elements, and wherein.

DETAILED DESCRIPTION OF THE ILLUSTRATED EMBODIMENT(S)

The following description describes an example communications system, an example text-to-speech (TTS) system that can be used with the communications system, an example automatic speech recognition system (ASR), and one or more example methods that can be used with one or more of the aforementioned systems. The methods described below can be used by a vehicle telematics unit (VTU) as a part of synthesizing speech for output to a user of the VTU. Although the methods described below are such as they might be implemented for a VTU in a vehicle context during program execution or runtime, it will be appreciated that they could be useful in any type of TTS system and other types of TTS systems and for contexts other than the vehicle context.

Communications System—

Figure 1:
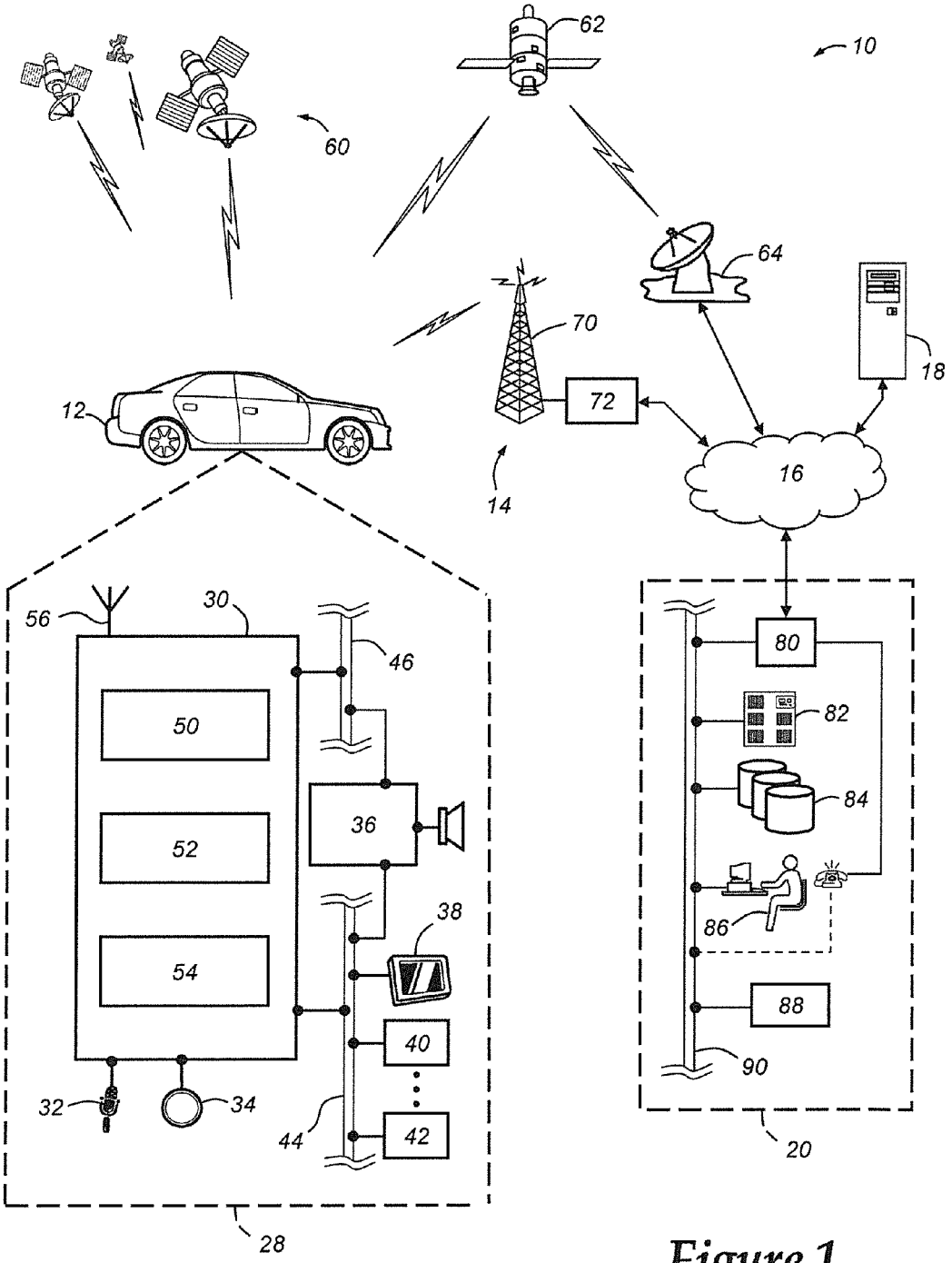
FIG. 1 is a block diagram depicting an illustrative embodiment of a communications system that is capable of utilizing the method disclosed herein.

With reference to FIG. 1, there is shown an illustrative operating environment that comprises a mobile vehicle communications system 10 and that can be used to implement the method disclosed herein. Communications system 10 generally includes a vehicle 12, one or more wireless carrier systems 14, a land communications network 16, a computer 18, and a call center 20. It should be understood that the disclosed method can be used with any number of different systems and is not specifically limited to the operating environment shown here. Also, the architecture, construction, setup, and operation of the system 10 and its individual components are generally known in the art. Thus, the following paragraphs simply provide a brief overview of one such illustrative system 10; however, other systems not shown here could employ the disclosed method as well.

Vehicle 12 is depicted in the illustrated embodiment as a passenger car, but it should be appreciated that any other vehicle including motorcycles, trucks, sports utility vehicles (SUVs), recreational vehicles (RVs), marine vessels, aircraft, etc., can also be used. Some of the vehicle electronics 28 is shown generally in FIG. 1 and includes a telematics unit 30, a microphone 32, one or more pushbuttons or other control inputs 34, an audio system 36, a visual display 38, and a GPS module 40 as well as a number of vehicle system modules (VSMs) 42. Some of these devices can be connected directly to the telematics unit such as, for example, the microphone 32 and pushbutton(s) 34, whereas others are indirectly connected using one or more network connections, such as a communications bus 44 or an entertainment bus 46. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

Telematics unit 30 can be an OEM-installed (embedded) or aftermarket device that enables wireless voice and/or data communication over wireless carrier system 14 and via wireless networking so that the vehicle can communicate with call center 20, other telematics-enabled vehicles, or some other entity or device. The telematics unit preferably uses radio transmissions to establish a communications channel (a voice channel and/or a data channel) with wireless carrier system 14 so that voice and/or data transmissions can be sent and received over the channel. By providing both voice and data communication, telematics unit 30 enables the vehicle to offer a number of different services including those related to navigation, telephony, emergency assistance, diagnostics, infotainment, etc. Data can be sent either via a data connection, such as via packet data transmission over a data channel, or via a voice channel using techniques known in the art. For combined services that involve both voice communication (e.g., with a live advisor or voice response unit at the call center 20) and data communication (e.g., to provide GPS location data or vehicle diagnostic data to the call center 20), the system can utilize a single call over a voice channel and switch as needed between voice and data transmission over the voice channel, and this can be done using techniques known to those skilled in the art.

According to one embodiment, telematics unit 30 utilizes cellular communication according to either GSM or CDMA standards and thus includes a standard cellular chipset 50 for voice communications like hands-free calling, a wireless modem for data transmission, an electronic processing device 52, one or more digital memory devices 54, and a dual antenna 56. It should be appreciated that the modem can either be implemented through software that is stored in the telematics unit and is executed by processor 52, or it can be a separate hardware component located internal or external to telematics unit 30. The modem can operate using any number of different standards or protocols such as EVDO, CDMA, GPRS, and EDGE. Wireless networking between the vehicle and other networked devices can also be carried out using telematics unit 30. For this purpose, telematics unit 30 can be configured to communicate wirelessly according to one or more wireless protocols, such as any of the IEEE 802.11 protocols, WiMAX, or Bluetooth. When used for packet-switched data communication such as TCP/IP, the telematics unit can be configured with a static IP address or can set up to automatically receive an assigned IP address from another device on the network such as a router or from a network address server.

Processor 52 can be any type of device capable of processing electronic instructions including microprocessors, microcontrollers, host processors, controllers, vehicle communication processors, and application specific integrated circuits (ASICs). It can be a dedicated processor used only for telematics unit 30 or can be shared with other vehicle systems. Processor 52 executes various types of digitally-stored instructions, such as software or firmware programs stored in memory 54, which enable the telematics unit to provide a wide variety of services. For instance, processor 52 can execute programs or process data to carry out at least a part of the method discussed herein.

Telematics unit 30 can be used to provide a diverse range of vehicle services that involve wireless communication to and/or from the vehicle. Such services include: turn-by-turn directions and other navigation-related services that are provided in conjunction with the GPS-based vehicle navigation module 40; airbag deployment notification and other emergency or roadside assistance-related services that are provided in connection with one or more collision sensor interface modules such as a body control module (not shown); diagnostic reporting using one or more diagnostic modules; and infotainment-related services where music, webpages, movies, television programs, videogames and/or other information is downloaded by an infotainment module (not shown) and is stored for current or later playback. The above-listed services are by no means an exhaustive list of all of the capabilities of telematics unit 30, but are simply an enumeration of some of the services that the telematics unit is capable of offering. Furthermore, it should be understood that at least some of the aforementioned modules could be implemented in the form of software instructions saved internal or external to telematics unit 30, they could be hardware components located internal or external to telematics unit 30, or they could be integrated and/or shared with each other or with other systems located throughout the vehicle, to cite but a few possibilities. In the event that the modules are implemented as VSMs 42 located external to telematics unit 30, they could utilize vehicle bus 44 to exchange data and commands with the telematics unit.

GPS module 40 receives radio signals from a constellation 60 of GPS satellites. From these signals, the module 40 can determine vehicle position that is used for providing navigation and other position-related services to the vehicle driver. Navigation information can be presented on the display 38 (or other display within the vehicle) or can be presented verbally such as is done when supplying turn-by-turn navigation. The navigation services can be provided using a dedicated in-vehicle navigation module (which can be part of GPS module 40), or some or all navigation services can be done via telematics unit 30, wherein the position information is sent to a remote location for purposes of providing the vehicle with navigation maps, map annotations (points of interest, restaurants, etc.), route calculations, and the like. The position information can be supplied to call center 20 or other remote computer system, such as computer 18, for other purposes, such as fleet management. Also, new or updated map data can be downloaded to the GPS module 40 from the call center 20 via the telematics unit 30.

Apart from the audio system 36 and GPS module 40, the vehicle 12 can include other vehicle system modules (VSMs) 42 in the form of electronic hardware components that are located throughout the vehicle and typically receive input from one or more sensors and use the sensed input to perform diagnostic, monitoring, control, reporting and/or other functions. Each of the VSMs 42 is preferably connected by communications bus 44 to the other VSMs, as well as to the telematics unit 30, and can be programmed to run vehicle system and subsystem diagnostic tests. As examples, one VSM 42 can be an engine control module (ECM) that controls various aspects of engine operation such as fuel ignition and ignition timing, another VSM 42 can be a powertrain control module that regulates operation of one or more components of the vehicle powertrain, and another VSM 42 can be a body control module that governs various electrical components located throughout the vehicle, like the vehicle's power door locks and headlights. According to one embodiment, the engine control module is equipped with on-board diagnostic (OBD) features that provide myriad real-time data, such as that received from various sensors including vehicle emissions sensors, and provide a standardized series of diagnostic trouble codes (DTCs) that allow a technician to rapidly identify and remedy malfunctions within the vehicle. As is appreciated by those skilled in the art, the above-mentioned VSMs are only examples of some of the modules that may be used in vehicle 12, as numerous others are also possible.

Vehicle electronics 28 also includes a number of vehicle user interfaces that provide vehicle occupants with a means of providing and/or receiving information, including microphone 32, pushbuttons(s) 34, audio system 36, and visual display 38. As used herein, the term 'vehicle user interface' broadly includes any suitable form of electronic device, including both hardware and software components, which is located on the vehicle and enables a vehicle user to communicate with or through a component of the vehicle. Microphone 32 provides audio input to the telematics unit to enable the driver or other occupant to provide voice commands and carry out hands-free calling via the wireless carrier system 14. For this purpose, it can be connected to an on-board automated voice processing unit utilizing human-machine interface (HMI) technology known in the art. The pushbutton(s) 34 allow manual user input into the telematics unit 30 to initiate wireless telephone calls and provide other data, response, or control input. Separate pushbuttons can be used for initiating emergency calls versus regular service assistance calls to the call center 20. Audio system 36 provides audio output to a vehicle occupant and can be a dedicated, stand-alone system or part of the primary vehicle audio system. According to the particular embodiment shown here, audio system 36 is operatively coupled to both vehicle bus 44 and entertainment bus 46 and can provide AM, FM and satellite radio, CD, DVD and other multimedia functionality. This functionality can be provided in conjunction with or independent of the infotainment module described above. Visual display 38 is preferably a graphics display, such as a touch screen on the instrument panel or a heads-up display reflected off of the windshield, and can be used to provide a multitude of input and output functions. Various other vehicle user interfaces can also be utilized, as the interfaces of FIG. 1 are only an example of one particular implementation.

Wireless carrier system 14 is preferably a cellular telephone system that includes a plurality of cell towers 70 (only one shown), one or more mobile switching centers (MSCs) 72, as well as any other networking components required to connect wireless carrier system 14 with land network 16. Each cell tower 70 includes sending and receiving antennas and a base station, with the base stations from different cell towers being connected to the MSC 72 either directly or via intermediary equipment such as a base station controller. Cellular system 14 can implement any suitable communications technology, including for example, analog technologies such as AMPS, or the newer digital technologies such as CDMA (e.g., CDMA2000) or GSM/GPRS. As will be appreciated by those skilled in the art, various cell tower/base station/MSC arrangements are possible and could be used with wireless system 14. For instance, the base station and cell tower could be co-located at the same site or they could be remotely located from one another, each base station could be responsible for a single cell tower or a single base station could service various cell towers, and various base stations could be coupled to a single MSC, to name but a few of the possible arrangements.

Apart from using wireless carrier system 14, a different wireless carrier system in the form of satellite communication can be used to provide uni-directional or bi-directional communication with the vehicle. This can be done using one or more communication satellites 62 and an uplink transmitting station 64. Uni-directional communication can be, for example, satellite radio services, wherein programming content (news, music, etc.) is received by transmitting station 64, packaged for upload, and then sent to the satellite 62, which broadcasts the programming to subscribers. Bi-directional communication can be, for example, satellite telephony services using satellite 62 to relay telephone communications between the vehicle 12 and station 64. If used, this satellite telephony can be utilized either in addition to or in lieu of wireless carrier system 14.

Land network 16 may be a conventional land-based telecommunications network that is connected to one or more landline telephones and connects wireless carrier system 14 to call center 20. For example, land network 16 may include a public switched telephone network (PSTN) such as that used to provide hardwired telephony, packet-switched data communications, and the Internet infrastructure. One or more segments of land network 16 could be implemented through the use of a standard wired network, a fiber or other optical network, a cable network, power lines, other wireless networks such as wireless local area networks (WLANs), or networks providing broadband wireless access (BWA), or any combination thereof. Furthermore, call center 20 need not be connected via land network 16, but could include wireless telephony equipment so that it can communicate directly with a wireless network, such as wireless carrier system 14.

Computer 18 can be one of a number of computers accessible via a private or public network such as the Internet. Each such computer 18 can be used for one or more purposes, such as a web server accessible by the vehicle via telematics unit 30 and wireless carrier 14. Other such accessible computers 18 can be, for example: a service center computer where diagnostic information and other vehicle data can be uploaded from the vehicle via the telematics unit 30; a client computer used by the vehicle owner or other subscriber for such purposes as accessing or receiving vehicle data or to setting up or configuring subscriber preferences or controlling vehicle functions; or a third party repository to or from which vehicle data or other information is provided, whether by communicating with the vehicle 12 or call center 20, or both. A computer 18 can also be used for providing Internet connectivity such as DNS services or as a network address server that uses DHCP or other suitable protocol to assign an IP address to the vehicle 12.

Call center 20 is designed to provide the vehicle electronics 28 with a number of different system back-end functions and, according to the illustrative embodiment shown here, generally includes one or more switches 80, servers 82, databases 84, live advisors 86, as well as an automated voice response system (VRS) 88, all of which are known in the art. These various call center components are preferably coupled to one another via a wired or wireless local area network 90. Switch 80, which can be a private branch exchange (PBX) switch, routes incoming signals so that voice transmissions are usually sent to either the live adviser 86 by regular phone or to the automated voice response system 88 using VoIP. The live advisor phone can also use VoIP as indicated by the broken line in FIG. 1. VoIP and other data communication through the switch 80 is implemented via a modem (not shown) connected between the switch 80 and network 90. Data transmissions are passed via the modem to server 82 and/or database 84. Database 84 can store account information such as subscriber authentication information, vehicle identifiers, profile records, behavioral patterns, and other pertinent subscriber information. Data transmissions may also be conducted by wireless systems, such as 802.11x, GPRS, and the like. Although the illustrated embodiment has been described as it would be used in conjunction with a manned call center 20 using live advisor 86, it will be appreciated that the call center can instead utilize VRS 88 as an automated advisor or, a combination of VRS 88 and the live advisor 86 can be used.

Speech Synthesis System—

Figure 2:
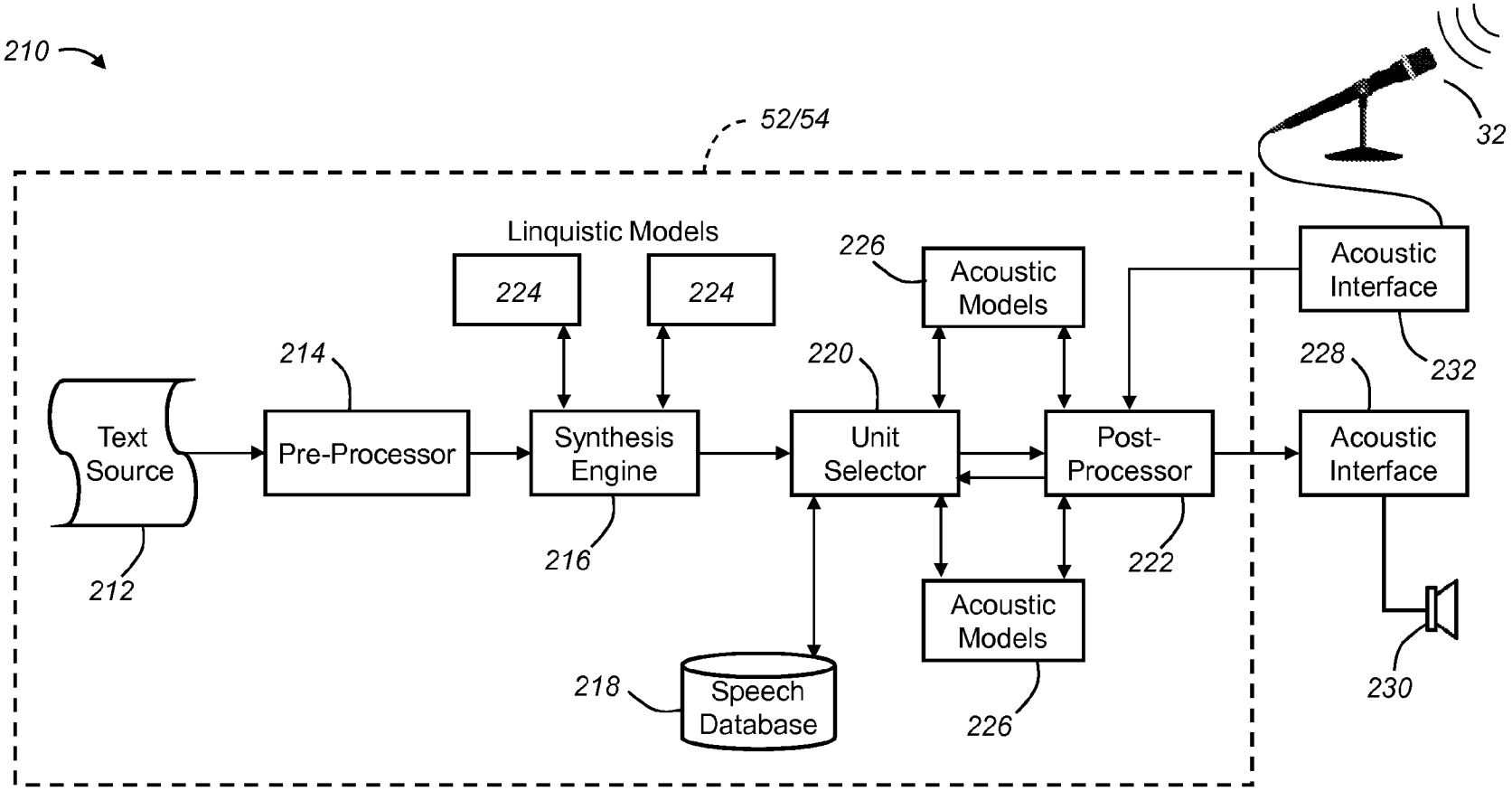
FIG. 2 is a block diagram illustrating an illustrative embodiment of a text-to-speech (TTS) system that can be used with the system of FIG. 1 and for implementing illustrative methods of speech synthesis.

Turning now to FIG. 2, there is shown an illustrative architecture for a text-to-speech (TTS) system 210 that can be used to enable the presently disclosed method. In general, a user or vehicle occupant may interact with a TTS system to receive instructions from or listen to menu prompts of an application, for example, a vehicle navigation application, a hands free calling application, or the like. There are many varieties of TTS synthesis, including formant TTS synthesis and concatenative TTS synthesis. Formant TTS synthesis does not output recorded human speech and, instead, outputs computer generated audio that tends to sound artificial and robotic. In concatenative TTS synthesis, segments of stored human speech are concatenated and output to produce smoother, more natural sounding speech. Generally, a concatenative TTS system extracts output words or identifiers from a source of text, converts the output into appropriate language units, selects stored units of speech that best correspond to the language units, converts the selected units of speech into audio signals, and outputs the audio signals as audible speech for interfacing with a user.

TTS systems are generally known to those skilled in the art, as described in the background section. But FIG. 2 illustrates an example of an improved TTS system according to the present disclosure. According to one embodiment, some or all of the system 210 can be resident on, and processed using, the telematics unit 30 of FIG. 1. According to an alternative illustrative embodiment, some or all of the TTS system 210 can be resident on, and processed using, computing equipment in a location remote from the vehicle 12, for example, the call center 20. For instance, linguistic models, acoustic models, and the like can be stored in memory of one of the servers 82 and/or databases 84 in the call center 20 and communicated to the vehicle telematics unit 30 for in-vehicle TTS processing. Similarly, TTS software can be processed using processors of one of the servers 82 in the call center 20. In other words, the TTS system 210 can be resident in the telematics unit 30 or distributed across the call center 20 and the vehicle 12 in any desired manner.

The system 210 can include one or more text sources 212, and a memory, for example the telematics memory 54, for storing text from the text source 212 and storing TTS software and data. The system 210 can also include a processor, for example the telematics processor 52, to process the text and function with the memory and in conjunction with the following system modules. A pre-processor 214 receives text from the text source 212 and converts the text into suitable words or the like. A synthesis engine 216 converts the output from the pre-processor 214 into appropriate language units like phrases, clauses, and/or sentences. One or more speech databases 218 store recorded speech. A unit selector 220 selects units of stored speech from the database 218 that best correspond to the output from the synthesis engine 216. A post-processor 222 modifies or adapts one or more of the selected units of stored speech. One or more or linguistic models 224 are used as input to the synthesis engine 216, and one or more voice or acoustic models 226 are used as input to the unit selector 220. The system 210 also can include an acoustic interface 228 to convert the selected units of speech into audio signals and a loudspeaker 230, for example of the telematics audio system, to convert the audio signals to audible speech. The system 210 further can include a microphone, for example the telematics microphone 32, and an acoustic interface 232 to digitize speech into acoustic data for use as feedback to the post-processor 222.

The text source 212 can be in any suitable medium and can include any suitable content. For example, the text source 212 can be one or more scanned documents, text files or application data files, or any other suitable computer files, or the like. The text source 212 can include words, numbers, symbols, and/or punctuation to be synthesized into speech and for output to the text converter 214. Any suitable quantity and type of text sources can be used.

The pre-processor 214 converts the text from the text source 212 into words, identifiers, or the like. For example, where text is in numeric format, the pre-processor 214 can convert the numerals to corresponding words. In another example, where the text is punctuation, emphasized with caps or other special characters like umlauts to indicate appropriate stress and intonation, underlining, or bolding, the pre-processor 214 can convert same into output suitable for use by the synthesis engine 216 and/or unit selector 220.

The synthesis engine 216 receives the output from the text converter 214 and can arrange the output into language units that may include one or more sentences, clauses, phrases, words, subwords, and/or the like. The engine 216 may use the linguistic models 224 for assistance with coordination of most likely arrangements of the language units. The linguistic models 224 provide rules, syntax, and/or semantics in arranging the output from the text converter 214 into language units. The models 224 can also define a universe of language units the system 210 expects at any given time in any given TTS mode, and/or can provide rules, etc., governing which types of language units and/or prosody can logically follow other types of language units and/or prosody to form natural sounding speech. The language units can be comprised of phonetic equivalents, like strings of phonemes or the like, and can be in the form of phoneme HMM's.

The speech database 218 includes pre-recorded speech from one or more people. The speech can include pre-recorded sentences, clauses, phrases, words, subwords of pre-recorded words, and the like. The speech database 218 can also include data associated with the pre-recorded speech, for example, metadata to identify recorded speech segments for use by the unit selector 220. Any suitable type and quantity of speech databases can be used.

The unit selector 220 compares output from the synthesis engine 216 to stored speech data and selects stored speech that best corresponds to the synthesis engine output. The speech selected by the unit selector 220 can include pre-recorded sentences, clauses, phrases, words, subwords of pre-recorded words, and/or the like. The selector 220 may use the acoustic models 226 for assistance with comparison and selection of most likely or best corresponding candidates of stored speech. The acoustic models 226 may be used in conjunction with the selector 220 to compare and contrast data of the synthesis engine output and the stored speech data, assess the magnitude of the differences or similarities therebetween, and ultimately use decision logic to identify best matching stored speech data and output corresponding recorded speech.

In general, the best matching speech data is that which has a minimum dissimilarity to, or highest probability of being, the output of the synthesis engine 216 as determined by any of various techniques known to those skilled in the art. Such techniques can include dynamic time-warping classifiers, artificial intelligence techniques, neural networks, free phoneme recognizers, and/or probabilistic pattern matchers such as Hidden Markov Model (HMM) engines. HMM engines are known to those skilled in the art for producing multiple TTS model candidates or hypotheses. The hypotheses are considered in ultimately identifying and selecting that stored speech data which represents the most probable correct interpretation of the synthesis engine output via acoustic feature analysis of the speech. More specifically, an HMM engine generates statistical models in the form of an "N-best" list of language unit hypotheses ranked according to HMM-calculated confidence values or probabilities of an observed sequence of acoustic data given one or another language units, for example, by the application of Bayes' Theorem.

In one embodiment, output from the unit selector 220 can be passed directly to the acoustic interface 228 or through the post-processor 222 without post-processing. In another embodiment, the post-processor 222 may receive the output from the unit selector 220 for further processing.

In either case, the acoustic interface 228 converts digital audio data into analog audio signals. The interface 228 can be a digital to analog conversion device, circuitry, and/or software, or the like. The loudspeaker 230 is an electroacoustic transducer that converts the analog audio signals into speech audible to a user and receivable by the microphone 32.

Automatic Speech Recognition System—

Figure 3:
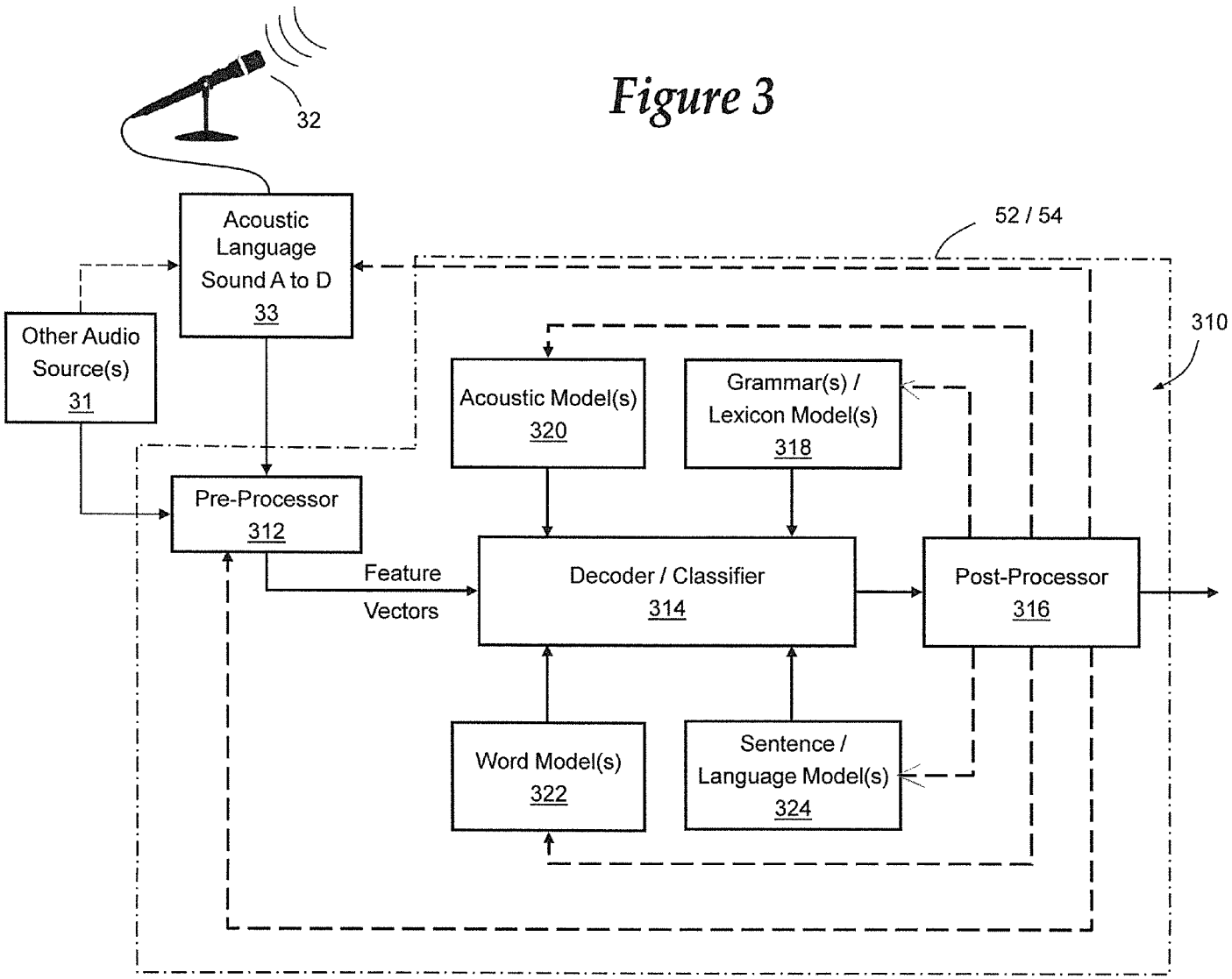
FIG. 3 is a block diagram illustrating an illustrative embodiment of an automatic speech recognition (ASR) system that can be used with the systems of FIGS. 1 and/or 2 and for implementing illustrative methods of speech synthesis.

Turning now to FIG. 3, there is shown an exemplary architecture for an ASR system 310 that can be used to enable the presently disclosed method. In general, a vehicle occupant vocally interacts with an automatic speech recognition system (ASR) for one or more of the following fundamental purposes: training the system to understand a vehicle occupant's particular voice; storing discrete speech such as a spoken nametag or a spoken control word like a numeral or keyword; or recognizing the vehicle occupant's speech for any suitable purpose such as voice dialing, menu navigation, transcription, service requests, vehicle device or device function control, or the like. Generally, ASR extracts acoustic data from human speech, compares and contrasts the acoustic data to stored subword data, selects an appropriate subword which can be concatenated with other selected subwords, and outputs the concatenated subwords or words for post-processing such as dictation or transcription, address book dialing, storing to memory, training ASR models or adaptation parameters, or the like.

ASR systems are generally known to those skilled in the art, and FIG. 3 illustrates just one specific exemplary ASR system 310. The system 310 includes a device to receive speech such as the telematics microphone 32, and an acoustic interface 33 such as a sound card of the telematics unit 30 having an analog to digital converter to digitize the speech into acoustic data. The system 310 also includes a memory such as the telematics memory 54 for storing the acoustic data and storing speech recognition software and databases, and a processor such as the telematics processor 52 to process the acoustic data. The processor functions with the memory and in conjunction with the following modules: one or more front-end processors, pre-processors, or pre-processor software modules 312 for parsing streams of the acoustic data of the speech into parametric representations such as acoustic features; one or more decoders or decoder software modules 314 for decoding the acoustic features to yield digital subword or word output data corresponding to the input speech utterances; and one or more back-end processors, post-processors, or post-processor software modules 316 for using the output data from the decoder module(s) 314 for any suitable purpose.

The system 310 can also receive speech from any other suitable audio source(s) 31, which can be directly communicated with the pre-processor software module(s) 312 as shown in solid line or indirectly communicated therewith via the acoustic interface 33. The audio source(s) 31 can include, for example, a telephonic source of audio such as a voice mail system, or other telephonic services of any kind.

One or more modules or models can be used as input to the decoder module(s) 314. First, grammar and/or lexicon model(s) 318 can provide rules governing which words can logically follow other words to form valid sentences. In a broad sense, a lexicon or grammar can define a universe of vocabulary the system 310 expects at any given time in any given ASR mode. For example, if the system 310 is in a training mode for training commands, then the lexicon or grammar model(s) 318 can include all commands known to and used by the system 310. In another example, if the system 310 is in a main menu mode, then the active lexicon or grammar model(s) 318 can include all main menu commands expected by the system 310 such as call, dial, exit, delete, directory, or the like. Second, acoustic model(s) 320 assist with selection of most likely subwords or words corresponding to input from the pre-processor module(s) 312. Third, word model(s) 322 and sentence/language model(s) 324 provide rules, syntax, and/or semantics in placing the selected subwords or words into word or sentence context. Also, the sentence/language model(s) 324 can define a universe of sentences the system 310 expects at any given time in any given ASR mode, and/or can provide rules, etc., governing which sentences can logically follow other sentences to form valid extended speech.

According to an alternative exemplary embodiment, some or all of the ASR system 310 can be resident on, and processed using, computing equipment in a location remote from the vehicle 12 such as the call center 20. For example, grammar models, acoustic models, and the like can be stored in memory of one of the servers 82 and/or databases 84 in the call center 20 and communicated to the vehicle telematics unit 30 for in-vehicle speech processing. Similarly, speech recognition software can be processed using processors of one of the servers 82 in the call center 20. In other words, the ASR system 310 can be resident in the telematics unit 30 or distributed across the call center 20 and the vehicle 12 in any desired manner, and/or resident at the call center 20.

First, acoustic data is extracted from human speech wherein a vehicle occupant speaks into the microphone 32, which converts the utterances into electrical signals and communicates such signals to the acoustic interface 33. A sound-responsive element in the microphone 32 captures the occupant's speech utterances as variations in air pressure and converts the utterances into corresponding variations of analog electrical signals such as direct current or voltage. The acoustic interface 33 receives the analog electrical signals, which are first sampled such that values of the analog signal are captured at discrete instants of time, and are then quantized such that the amplitudes of the analog signals are converted at each sampling instant into a continuous stream of digital speech data. In other words, the acoustic interface 33 converts the analog electrical signals into digital electronic signals. The digital data are binary bits which are buffered in the telematics memory 54 and then processed by the telematics processor 52 or can be processed as they are initially received by the processor 52 in real-time.

Second, the pre-processor module(s) 312 transforms the continuous stream of digital speech data into discrete sequences of acoustic parameters. More specifically, the processor 52 executes the pre-processor module(s) 312 to segment the digital speech data into overlapping phonetic or acoustic frames of, for example, 10-30 ms duration. The frames correspond to acoustic subwords such as syllables, demi-syllables, phones, diphones, phonemes, or the like. The pre-processor module(s) 312 also performs phonetic analysis to extract acoustic parameters from the occupant's speech such as time-varying feature vectors, from within each frame. Utterances within the occupant's speech can be represented as sequences of these feature vectors. For example, and as known to those skilled in the art, feature vectors can be extracted and can include, for example, vocal pitch, energy profiles, spectral attributes, and/or cepstral coefficients that can be obtained by performing Fourier transforms of the frames and decorrelating acoustic spectra using cosine transforms. Acoustic frames and corresponding parameters covering a particular duration of speech are concatenated into unknown test pattern of speech to be decoded.

Third, the processor executes the decoder module(s) 314 to process the incoming feature vectors of each test pattern. The decoder module(s) 314 is also known as a recognition engine or classifier, and uses stored known reference patterns of speech. Like the test patterns, the reference patterns are defined as a concatenation of related acoustic frames and corresponding parameters. The decoder module(s) 314 compares and contrasts the acoustic feature vectors of a subword test pattern to be recognized with stored subword reference patterns, assesses the magnitude of the differences or similarities therebetween, and ultimately uses decision logic to choose a best matching subword as the recognized subword. In general, the best matching subword is that which corresponds to the stored known reference pattern that has a minimum dissimilarity to, or highest probability of being, the test pattern as determined by any of various techniques known to those skilled in the art to analyze and recognize subwords. Such techniques can include dynamic time-warping classifiers, artificial intelligence techniques, neural networks, free phoneme recognizers, and/or probabilistic pattern matchers such as Hidden Markov Model (HMM) engines.

HMM engines are known to those skilled in the art for producing multiple speech recognition model hypotheses of acoustic input. The hypotheses are considered in ultimately identifying and selecting that recognition output which represents the most probable correct decoding of the acoustic input via feature analysis of the speech. More specifically, an HMM engine generates statistical models in the form of an "N-best" list of subword model hypotheses ranked according to HMM-calculated confidence values or probabilities of an observed sequence of acoustic data given one or another subword such as by the application of Bayes' Theorem.

A Bayesian HMM process identifies a best hypothesis corresponding to the most probable utterance or subword sequence for a given observation sequence of acoustic feature vectors, and its confidence values can depend on a variety of factors including acoustic signal-to-noise ratios associated with incoming acoustic data. The HMM can also include a statistical distribution called a mixture of diagonal Gaussians, which yields a likelihood score for each observed feature vector of each subword, which scores can be used to reorder the N-best list of hypotheses. The HMM engine can also identify and select a subword whose model likelihood score is highest.

In a similar manner, individual HMMs for a sequence of subwords can be concatenated to establish single or multiple word HMM. Thereafter, an N-best list of single or multiple word reference patterns and associated parameter values may be generated and further evaluated.

In one example, the speech recognition decoder 314 processes the feature vectors using the appropriate acoustic models, grammars, and algorithms to generate an N-best list of reference patterns. As used herein, the term reference patterns is interchangeable with models, waveforms, templates, rich signal models, exemplars, hypotheses, or other types of references. A reference pattern can include a series of feature vectors representative of one or more words or subwords and can be based on particular speakers, speaking styles, and audible environmental conditions. Those skilled in the art will recognize that reference patterns can be generated by suitable reference pattern training of the ASR system and stored in memory. Those skilled in the art will also recognize that stored reference patterns can be manipulated, wherein parameter values of the reference patterns are adapted based on differences in speech input signals between reference pattern training and actual use of the ASR system. For example, a set of reference patterns trained for one vehicle occupant or certain acoustic conditions can be adapted and saved as another set of reference patterns for a different vehicle occupant or different acoustic conditions, based on a limited amount of training data from the different vehicle occupant or the different acoustic conditions. In other words, the reference patterns are not necessarily fixed and can be adjusted during speech recognition.

Using the in-vocabulary grammar and any suitable decoder algorithm(s) and acoustic model(s), the processor accesses from memory several reference patterns interpretive of the test pattern. For example, the processor can generate, and store to memory, a list of N-best vocabulary results or reference patterns, along with corresponding parameter values. Exemplary parameter values can include confidence scores of each reference pattern in the N-best list of vocabulary and associated segment durations, likelihood scores, signal-to-noise ratio (SNR) values, and/or the like. The N-best list of vocabulary can be ordered by descending magnitude of the parameter value(s). For example, the vocabulary reference pattern with the highest confidence score is the first best reference pattern, and so on. Once a string of recognized subwords are established, they can be used to construct words with input from the word models 322 and to construct sentences with the input from the language models 324.

Finally, the post-processor software module(s) 316 receives the output data from the decoder module(s) 314 for any suitable purpose. In one example, the post-processor software module(s) 316 can identify or select one of the reference patterns from the N-best list of single or multiple word reference patterns as recognized speech. In another example, the post-processor module(s) 316 can be used to convert acoustic data into text or digits for use with other aspects of the ASR system or other vehicle systems. In a further example, the post-processor module(s) 316 can be used to provide training feedback to the decoder 314 or pre-processor 312. More specifically, the post-processor 316 can be used to train acoustic models for the decoder module(s) 314, or to train adaptation parameters for the pre-processor module(s) 312.

Methods—

Figure 4:
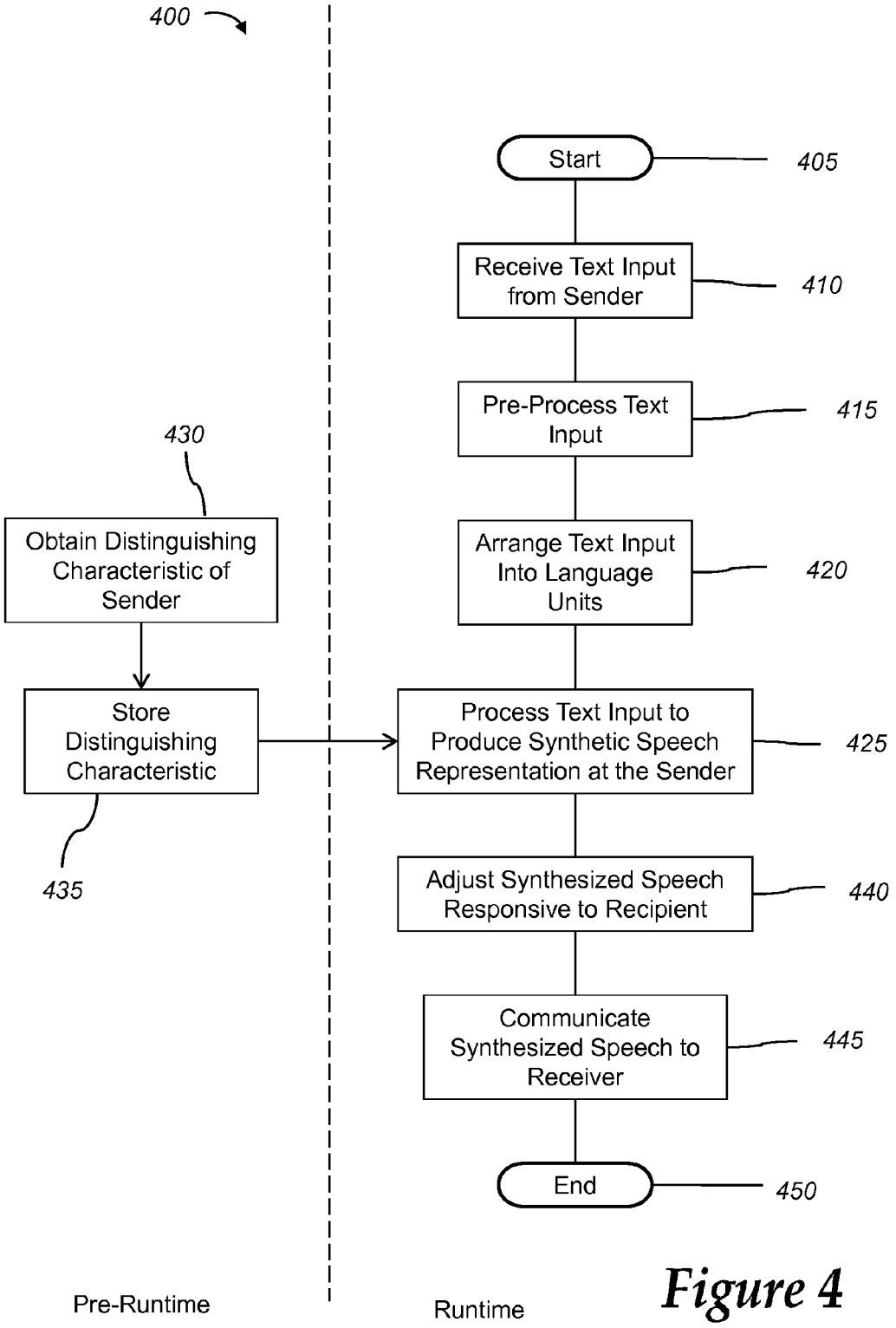
FIG. 4 is a flow chart illustrating an illustrative embodiment of a method of speech synthesis that can be carried out by the communication system of FIG. 1, and the TTS system of FIG. 2.

Turning now to FIG. 4, there is shown a speech synthesis method 400. The method 400 of FIG. 4 can be carried out using suitable programming of the TTS system 210 of FIG. 2 and of the ASR system 310 of FIG. 3 within the operating environment of the vehicle telematics unit 30 as well as using suitable hardware and programming of the other components shown in FIG. 1. These features of any particular implementation will be known to those skilled in the art based on the above descriptions of systems and the discussion of the method described below in conjunction with the remaining figures. Those skilled in the art will also recognize that the method can be carried out using other TTS and ASR systems within other operating environments.

In general, the method 400 includes receiving a text input sent by a sender, processing the text input responsive to at least one distinguishing characteristic of the sender to produce synthesized speech that is representative of a voice of the sender, and communicating the synthesized speech to a user of the system. In one embodiment, the distinguishing characteristic can be obtained from a former communication session, which preceded a current communication session in which the text input is being processed. In one implementation, the distinguishing characteristic can include acoustic information or conversational demographic information. In another implementation, the distinguishing characteristic can include textual demographic information or behavioral demographic information.

In one embodiment, the at least one distinguishing characteristic can include at least one collective attribute representative of a group to which the sender belongs. For example, the at least one collective attribute can include at least one of gender, age, ethnicity, dialect, and/or accent.

In another embodiment, the at least one distinguishing characteristic includes at least one individual attribute that is personal to the sender that created the text input. For example, the at least one individual attribute can be prosodic and can include at least one of pitch, intonation, pronunciation, stress, articulation rate, tone, loudness, and/or formant frequencies.

Referring again to FIG. 4, the method 400 begins in any suitable manner at step 405. For example, a vehicle user starts interaction with the user interface of the telematics unit 30, preferably by depressing the user interface push-button 34 to begin a session in which the user receives TTS audio from the telematics unit 30 while operating in a TTS mode. In one illustrative embodiment, the method 400 may begin as part of a TTS message-receiving application of the telematics unit 30.

At step 410, a text input created by a sender is received in a TTS system for speech synthesis and communication to a recipient. For example, the text input can include a string of letters, numbers, symbols, a representation of the aforementioned items, or the like. More specifically, the text input can include a text message like "c u in 2 hrs@ yr ofc." The sender is a person who uses any suitable hardware, software, and network to create and send a text message. The process of creating and sending the text input is not the subject of the present disclosure, and any suitable system, apparatus, and techniques for doing are contemplated herein. In any event, the text input can be received by the TTS system 210 in any suitable manner and stored as part of the text source 212 of the TTS system 210 in any suitable system memory.

At step 415, the text input can be pre-processed to convert the text input into a format suitable for speech synthesis. For instance, the pre-processor 214 can convert the stored text input from the text source 212 into words, identifiers, or the like for use by the synthesis engine 216. More specifically, the example text from step 410 can be converted into "see you in two hours at your office."

At step 420, the text input can be arranged into language units. For instance, the synthesis engine 216 can receive the formatted text input from the text converter 214 and, with the linguistic models 224, can arrange the text input into language units that may include one or more sentences, clauses, phrases, words, subwords, and/or the like. The language units can be comprised of phonetic equivalents, like strings of phonemes or the like.

At step 425, language units can be compared to stored data of speech, and the speech that best corresponds to the language units can be selected as speech representative of the input text. For instance, the unit selector 220 of the TTS system 210 of FIG. 2 can use the TTS voice models 226 to compare the language units output from the synthesis engine 216 to speech data stored in the speech database 218 and select stored speech having associated data that best corresponds to the synthesis engine output. Step 425 can constitute an example of concatenative TTS, including processing or synthesizing the text input into speech output using stored speech, which may be speech of the sender, speech from a commercial speech database, or the like. Concatenative TTS is typically suitable for use in static, finite, or rigid TTS rendering sets. Also, as described below in steps 430 and 435, and as will be described in further detail below with reference to FIG. 5, the text input may be processed responsive to at least one distinguishing characteristic of the sender to produce synthesized speech that is representative of a voice of the sender.

The representative synthesized speech is different from default synthesized speech that would otherwise be communicated to a recipient. The default synthesized speech might be generic concatenated speech, such as from a commercial database. Such generic speech is completely independent of the particular voice of the sender of the text message. In contrast, the representative synthesized speech is specifically selected or modified to represent the sender's voice more closely than would otherwise be possible.

At step 430, a distinguishing characteristic of the sender can be obtained, for example, from a former or previous communication session between the sender and the recipient. As will be described in further detail below with reference to FIG. 5, the former communication session may have been a previous live conversation between the sender and recipient, a recorded voice message from the sender, a text message from the sender, or the like.

At step 435, the distinguishing characteristic can be stored. For example, the distinguishing characteristic can be stored in any suitable memory, for instance, in call center memory 84 or in-vehicle memory 54. More specifically, the distinguishing characteristic can be stored in association with a database entry of the sender, a user/sender profile, or contact entry in a contact list, or the like. Accordingly, the distinguishing characteristic can be updated or overwritten over time. Also, a plurality of distinguishing characteristics can be stored over time for improved TTS performance.

At step 440, the synthesized speech can be adjusted responsive to the recipient. For example, for a sender who speaks English as a primary language or speaks very fast, and a recipient who speaks English as a second language, the recipient may desire the TTS synthesized speech to be rendered more slowly. Accordingly, the parameter can include an articulation rate. In another example, for a sender who speaks or texts very casually, the recipient may desire the TTS synthesized speech to be more formal or courteous. Accordingly, the parameter can include courteousness.

In one example of step 450, acoustic features of baseline speech can be analyzed for one or more baseline characteristics. For example, the baseline speech may be speech that the recipient is accustomed to hearing in terms of articulation rate, courteousness, and the like. Then, an acoustic feature filter, which is used to filter acoustic features from the synthesized speech, can be adjusted based on the baseline speech characteristics and, thereafter, acoustic features from the synthesized speech can be filtered using the adjusted filter. For instance, the filter can be adjusted by adjusting one or more parameters of a mel-frequency cepstrum filter. The parameters can include filter bank central frequencies, filter bank cutoff frequencies, filter bank bandwidths, filter bank shape, filter gain, and/or the like. The baseline characteristics can include at least one of articulation rate, courteousness, formants, pitch frequency, and/or the like. In general, acoustic feature extraction is well known to those of ordinary skill in the art, and the acoustic features can include Mel-frequency Cepstral Coefficients (MFCCs), relative spectral transform—perceptual linear prediction features (RASTA-PLP features), or any other suitable acoustic features.

At step 445, the selected stored speech can be communicated to a recipient. For example, the pre-recorded speech that is selected from the database 218 can be output through the interface 228 and speaker 230 using any suitable techniques.

At step 450, the method may end in any suitable manner.

Figure 5:
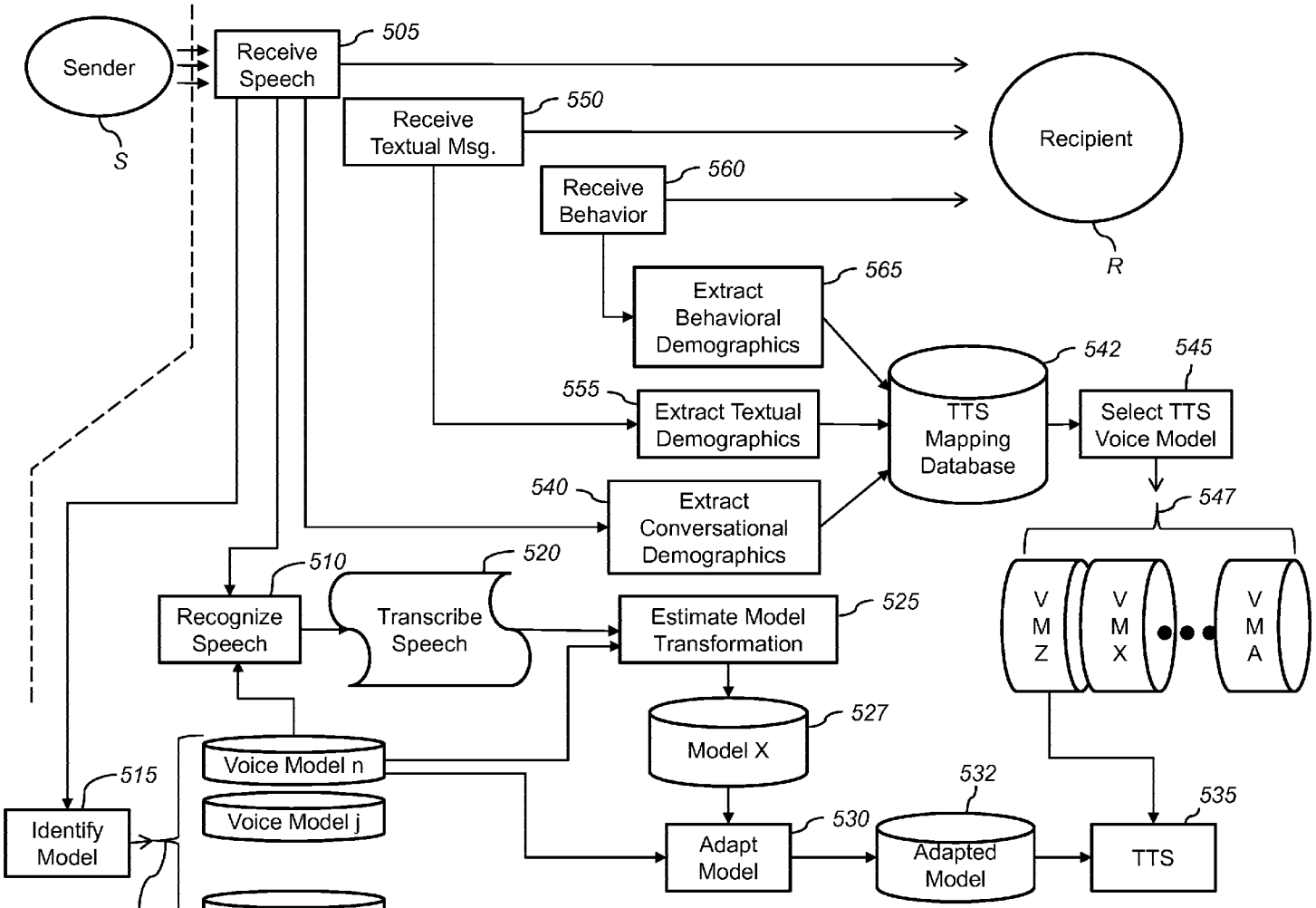
FIG. 5 is a schematic flow diagram illustrating another illustrative embodiment of a method of speech synthesis that can be carried out by the communication system of FIG. 1, the TTS system of FIG. 2, and the ASR system of FIG. 3.

FIG. 5 is a flow diagram illustrating various communication flow paths between a sender S and a recipient R, wherein TTS voice models may be selected and/or adapted for use during a subsequent text communication session to produce synthesized speech that is representative of a voice of the sender S of the text input. Accordingly, FIG. 5 represents a first or upstream stage of a method of the present disclosure in which information about a text message sender is obtained. Conversely, steps 405 through 425 of FIG. 4 generally represent a second or downstream stage of the method in which the obtained information is used to improve TTS synthesis.

At step 505, in a first communication flow path, speech from the sender S to the recipient R can be received. In one example, the speech can be intercepted in any suitable manner from a live conversation during a telecommunication session between the sender and the recipient, and then stored in call center memory 84, in-vehicle memory 54, or the like. In another example, the speech can be received from a voice message from the sender to the recipient's voice mailbox that may be stored in call center memory 84, in-vehicle memory 54, or the like.

At step 510, the speech can be recognized, for instance, using the decoder of the ASR system 310 of FIG. 3. The speech can be pre-processed to generate acoustic feature vectors. For example, the acoustic data from the received speech can be pre-processed by the pre-processor module(s) 312 of the ASR system 310 as described above. Then, the generated acoustic feature vectors can decoded using an acoustic model to produce a plurality of hypotheses for the received speech. For example, the decoder module(s) 314 of the ASR system 310 can be used to decode the acoustic feature vectors. The acoustic model can be a universal, baseline, or default acoustic model, or can be an acoustic model trained on the sender's speech over time. Thereafter, the plurality of hypotheses can be post-processed to identify one of the plurality of hypotheses as the received speech. For example, the post-processor 316 of the ASR system 310 can post-process the hypotheses to identify the first-best hypothesis as the received speech. In another example, the post-processor 316 can reorder the N-best list of hypotheses in any suitable manner and identify the reordered first-best hypothesis.

The speech decoding can be carried out using any suitable voice or acoustic model(s) 517. In one embodiment, a single baseline or default acoustic model can be used. In another embodiment, one of a plurality of possible acoustic models can be used.

At step 515, for example, the received speech can be pre-processed to select an acoustic model from among a plurality of acoustic models 517. In this example, acoustic information from the received speech may be extracted, for instance, by the pre-processor of the ASR system 310 of FIG. 3. That acoustic information can be used to select an appropriate one of the models 517 for current use in recognizing the speech received from the sender, or for later use in modifying pre-recorded speech or computer generated speech during a TTS process. Accordingly, the processing step 425 of FIG. 4 can include using a TTS model selected from a plurality of TTS models in response to the distinguishing characteristic of the sender S.

In either embodiment of this flow path, at step 520, recognized speech can be transcribed for use in defining phonemes, phoneme boundaries, and the like in the speech. For example, the post-processor of the ASR system 310 of FIG. 3 can be used to produce a transcript of the speech, and the pre-processor and/or the post-processor of the ASR system 310 of FIG. 3 can be used to define the corresponding phonemes, phoneme boundaries, and the like.

At step 525, voice model transformations can be estimated based on the transcribed speech, phoneme boundaries, voice model, and the like. Here, an acoustic feature space transform may be learned from speech frames extracted from the received speech. For example, for a TTS system based on Hidden Markov Models (HMM5), each Gaussian distribution can be adapted based on the speech received from the sender. More specifically, maximum likelihood linear regression (MLLR) techniques may be used wherein a transform is estimated for each phoneme or set of phonemes by maximizing a likelihood of the received speech data. MLLR algorithms may use different variants of prosodic attributes including intonation, speaking rate, spectral energy, pitch, stress, pronunciation, and/or the like. The relationship between two or more of the various attributes and the speech recognition can be defined in any suitable manner. For example, a speech recognition score may be calculated as a sum of weighted prosodic attributes according to a formula, for instance, a*stress+b*intonation+c*speaking rate. The models can be estimated using a Gaussian probability density function representing the attributes, wherein the weights a, b, c, can be modified until a most likely model is obtained. Gaussian mixture models and parameters can be estimated using a MLLR algorithm, or any other suitable technique(s). The output of step 525 is a model transformation 527.

At step 530, the model transformation 527 may be used to adapt one or more of the voice models 517. For example, the model transformation step 530 transforms the default or originally identified model to more closely match the voice of the sender S. The default or originally identified model is received and the adaptation or transform 527 is applied thereto. More specifically, the model adaptation step can produce an adapted TTS voice model with modified parameters or probability density functions instead of parameters of the default or originally identified model. In one example, the model transformation step can be used to adjust central frequencies of the default or originally identified model. The model 517 can include TTS Hidden Markov Models (HMMs) that can be adapted in any suitable manner. The models can be adapted at the telematics unit 30 and/or at the call center 20. Any suitable MLLR technique(s) may be used and are well known to those of ordinary skill in the art as reflected by Variance Compensation Within the MLLR Framework for Robust Speech Recognition and Speaker Adaptation, Gales, M., D. Pye, and P. Woodland, In Proc. ICSLP, pp. 1832-1835, (1996).

At step 535, the adapted model can be used in a subsequent TTS session to produce synthesized speech that is representative of the voice of the sender S. Accordingly, the processing step 425 of FIG. 4 can include using a TTS model adapted in response to the distinguishing characteristic.

According to a second communication flow path, at step 540, conversational demographic information can be extracted from the received speech. For example, patterns in conversation between the sender and the recipient can be analyzed or recognized for demographic information. Conversational demographic information may include, for example, ethnicity or geographic residence of the sender, an age of the sender, or the like. Such information can be used to infer a dialect of the sender, a speaking rate of the sender, or the like. The conversational patterns may include spoken conjunctions like "y'all" or spoken regionalisms like "pop" (instead of "soda") or spoken colloquialisms like "ain't". The extracted conversational demographic information extracted in step 540 can be stored in a TTS demographic mapping database 542. The database 542 can include the call center database 84, or in memory 54 of the vehicle.

At step 545, one of a plurality of different TTS voice models 547 can be selected in response to the TTS demographic mapping database. For example, the models 547 may include dialect-specific models. To illustrate, if the database stores demographic information indicating that the sender is an elderly Hispanic female from Texas, then one or more TTS voice models based on or trained on elderly Hispanic females from Texas can be selected for use in a subsequent TTS session from the sender to the recipient. Accordingly, the processing step 425 of FIG. 4 can include using a TTS model selected from a plurality of TTS models in response to the distinguishing characteristic. In another example, the processing step 425 of FIG. 4 can include using a TTS model that was selected from a plurality of TTS models in response to the distinguishing characteristic, and that was thereafter adapted in response to the distinguishing characteristic.

According to a third communication flow path, at step 550, a text message from the sender to the recipient can be received. In one example, the text message can be stored in call center memory 84, in-vehicle memory 54, or the like.

At step 555, textual demographic information can be extracted from the received text message. For example, patterns in textual messaging between the sender and the recipient can be analyzed or recognized for demographic information. Textual demographic information may include, for example, ethnicity or geographic residence of the sender, an age of the sender, or the like. Such information can be used to infer a dialect of the sender, a speaking rate of the sender, or the like. The textual patterns may include textual conjunctions like "y'all" or textual regionalisms like "pop" (instead of "soda") or textual colloquialisms like "ain't". The extracted textual demographic information can be stored in the TTS demographic mapping database 542.

According to a fourth communication flow path, at step 560, behavioral information from the sender to the recipient can be received. In one example, the behavioral information can be stored in call center memory 84, in-vehicle memory 54, or the like.

At step 565, behavioral demographic information can be extracted from the received behavioral information. For example, patterns in behavior between the sender and the recipient can be analyzed or recognized for demographic information. Behavioral demographic information may include, for example, courteousness, speaking volume, emphasized texting via all capital letters or the like, or any other behavioral information. The extracted behavioral demographic information can be stored in the TTS demographic mapping database 542. In this case, at step 545, one of a plurality of different TTS voice models 547 can be selected in response to the TTS demographic mapping database 542. For example, the models 547 also or instead may include behavior-specific models. To illustrate, if the database stores demographic information indicating that the sender speaks loudly and discourteously, then one or more TTS voice models based on or trained on loud and discourteous speakers can be selected for use in a subsequent TTS session from the sender to the recipient.

The method or parts thereof can be implemented in a computer program product including instructions carried on a computer readable medium for use by one or more processors of one or more computers to implement one or more of the method steps. The computer program product may include one or more software programs comprised of program instructions in source code, object code, executable code or other formats; one or more firmware programs; or hardware description language (HDL) files; and any program related data. The data may include data structures, look-up tables, or data in any other suitable format. The program instructions may include program modules, routines, programs, objects, components, and/or the like. The computer program can be executed on one computer or on multiple computers in communication with one another.

The program(s) can be embodied on computer readable media, which can include one or more storage devices, articles of manufacture, or the like. Illustrative computer readable media include computer system memory, e.g. RAM (random access memory), ROM (read only memory); semiconductor memory, e.g. EPROM (erasable, programmable ROM), EEPROM (electrically erasable, programmable ROM), flash memory; magnetic or optical disks or tapes; and/or the like. The computer readable medium may also include computer to computer connections, for example, when data is transferred or provided over a network or another communications connection (either wired, wireless, or a combination thereof). Any combination(s) of the above examples is also included within the scope of the computer-readable media. It is therefore to be understood that the method can be at least partially performed by any electronic articles and/or devices capable of executing instructions corresponding to one or more steps of the disclosed method.

It is to be understood that the foregoing is a description of one or more preferred illustrative embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the invention can be applied to other fields of speech signal processing, for instance, mobile telecommunications, voice over internet protocol applications, and the like. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method of speech synthesis, comprising the steps of:

(a) receiving speech input from a sender;

(b) obtaining at least one distinguishing characteristic of the sender from the speech input, wherein the at least one distinguishing characteristic includes conversational information or textual information of the speech input;

(c) obtaining baseline characteristics, wherein the baseline characteristics include articulation rate, courteousness, formants, or pitch frequency that a recipient user of the system is accustomed to hearing;

(d) selecting a default text-to-speech model based on the at least one distinguishing characteristic of the sender;

(e) modifying the selected default text-to-speech model using the received speech input;

(f) receiving, at a text-to-speech system, a text input sent by the sender;

(g) processing, via a processor of the system and the text-to-speech model, the text input responsive to the at least one distinguishing characteristic of the sender to produce synthesized speech that is representative of a voice of the sender;

(h) identifying baseline characteristics of the synthesized speech;

(i) applying an acoustic feature filter to the synthesized speech, wherein the acoustic feature filter is adjusted using the baseline characteristics obtained from the received speech; and (j) communicating the synthesized speech to the recipient user of the system.

2. The method of claim 1 wherein the at least one distinguishing characteristic is obtained from a former communication between the sender and the recipient.

3. The method of claim 2 wherein the at least one distinguishing characteristic includes at least one of acoustic information or conversational demographic information extracted from a previous voice communication session with the sender.

4. The method of claim 2 wherein the at least one distinguishing characteristic includes textual demographic information extracted from a previous text communication session with the sender.

5. The method of claim 2 wherein the at least one distinguishing characteristic includes behavioral demographic information extracted from a previous voice or text communication with the sender.

6. The method of claim 5 wherein the at least one distinguishing characteristic also includes textual demographic information and at least one of acoustic information or conversational demographic information extracted from a previous voice communication session with the sender.

7. The method of claim 1 wherein the processing step includes using a TTS model that was selected from a plurality of TTS models in response to the at least one distinguishing characteristic, and was thereafter adapted in response to the at least one distinguishing characteristic.

8. The method of claim 1 wherein the at least one distinguishing characteristic includes at least one collective attribute representative of a group to which the sender belongs.

9. The method of claim 8 wherein the at least one collective attribute includes at least one of gender, age, ethnicity, dialect, or accent.

10. The method of claim 1 wherein the at least one distinguishing characteristic includes at least one individual attribute that is personal to the sender that created the text input.

11. The method of claim 10 wherein the at least one individual attribute is prosodic and includes at least one of pitch, intonation, pronunciation, stress, articulation rate, tone, loudness, or formant frequencies.

12. A computer program product embodied in a non-transitory computer readable medium and including instructions usable by a computer processor of a TTS system to cause the system to implement steps of a method according to claim 1.

13. A method of speech synthesis, comprising the steps of:

(a) obtaining at least one distinguishing characteristic of a sender from received speech input obtained during a communication session with the sender, wherein the at least one distinguishing characteristic includes conversational information or textual information of the speech input, and further obtaining baseline characteristics including articulation rate, courteousness, formants, or pitch frequency that a recipient is accustomed to hearing;

(b) selecting a text-to-speech model based on the at least one distinguishing characteristic of the sender;

(c) modifying the selected text-to-speech model using the at least one distinguishing characteristic of the sender;

(d) receiving, at a text-to-speech (TTS) system, a text input sent by the sender in a subsequent communication session with the sender;

(e) processing, via a processor of the system, the text input responsive to the modified text-to-speech model to produce synthesized speech that is representative of a voice of the sender of the text input;

(f) identifying baseline characteristics of the synthesized speech;

(g) applying an acoustic feature filter to the synthesized speech, wherein the acoustic feature filter is adjusted using the baseline characteristics obtained from the received speech; and (h) communicating the synthesized speech to a user of the system, the user being the recipient of the communication session.

14. The method of claim 13, wherein the obtaining step includes:

(a1) receiving, at an automatic speech recognition system, audio from the sender;

(a2) pre-processing the received audio to generate acoustic feature vectors;

(a3) decoding the generated acoustic feature vectors to produce a plurality of speech hypotheses;

(a4) post-processing the speech hypotheses to identify speech in the audio from the sender and to create a transcript of the identified speech; and (a5) storing the identified speech.

15. The method of claim 14, wherein the modifying of the text-to-speech model in step (c) comprises:

estimating a model transformation; and applying the model transformation to the TTS model selected in step (b) to produce an adapted TTS model, wherein the processing step (e) includes using the adapted TTS model to produce the synthesized speech.

16. The method of claim 15, wherein the step of adapting the TTS model is carried out on speech in a voice mail message from the sender and in response to receiving the voice mail message.

* * * * *